US005347287A

United States Patent [19]

Speciale

[11] Patent Number: 5,347,287

[45] Date of Patent: Sep. 13, 1994

[54] CONFORMAL PHASED ARRAY ANTENNA

[75] Inventor: Ross A. Speciale, Redondo Beach, Calif.

[73] Assignee: Hughes Missile Systems Company, Los Angeles, Calif.

[21] Appl. No.: 687,662

[22] Filed: Apr. 19, 1991

[51] Int. Cl.[5] ..... H01Q 3/22

[52] U.S. Cl. ..... 342/375; 342/368; 342/372; 343/771

[58] Field of Search ..... 342/375, 368, 372, 371; 343/770, 771, 754

[56] References Cited

U.S. PATENT DOCUMENTS

| | | | |
|---|---|---|---|
| 3,496,571 | 2/1970 | Walter et al. | 343/768 |
| 3,509,571 | 4/1970 | Jones, Jr. et al. | 343/771 |
| 3,530,478 | 9/1970 | Corzine et al. | 343/771 |
| 3,633,207 | 1/1972 | Ingerson | 343/770 |
| 3,718,933 | 2/1973 | Huele | 343/771 |
| 3,775,771 | 11/1973 | Scherrer | 343/770 |
| 4,063,243 | 12/1977 | Anderson et al. | 343/100 |
| 4,112,431 | 9/1978 | Wild | 343/768 |
| 4,270,129 | 5/1981 | Haper et al. | 343/703 |
| 4,348,679 | 9/1982 | Shnitkin et al. | 343/768 |
| 4,450,448 | 5/1984 | Albanese et al. | 343/379 |
| 4,575,727 | 3/1986 | Stern et al. | 343/768 |
| 4,613,869 | 9/1986 | Ajioka et al. | 343/768 |
| 4,616,230 | 10/1986 | Antonucci et al. | 342/373 |
| 4,656,482 | 4/1987 | Peng | 343/705 |
| 4,673,942 | 6/1987 | Yokoyama | 342/368 |
| 4,686,533 | 8/1987 | MacDonald et al. | 342/371 |
| 4,852,973 | 8/1989 | Durnin et al. | 350/162.11 |
| 4,864,311 | 9/1989 | Bennett et al. | 342/368 |
| 4,939,527 | 7/1990 | Lamberty et al. | 343/771 |

*Primary Examiner*—Theodore M. Blum
*Attorney, Agent, or Firm*—Charles D. Brown; Randall M. Heald; Wanda K. Denson-Low

[57] ABSTRACT

An array of antenna elements are configured in a lattice-like layer, each element being similarly oriented such that the elements form a two-dimensional antenna aperture that may form a planar or curved surface of a desired shape. The antenna elements are connected in a one-to-one correspondence in both number and form to a lattice of identical, multiport, isotropic, wave-coupling networks physically located under the antenna element array as a backplane of the antenna element layer. Each wave-coupling network or "unit cell" couples signals to and/or from its corresponding antenna element and further functions as a phase delay module in a two-dimensional signal distribution network. This invention can be embodied in a two-dimensional signal distribution network and in a wrap-around, conformal, millimeter-wave, phased array antenna, such as on the nose of a missile. A backplane of densely-packed resonant cavities feeds an outboard-facing layer of resonant slots configured in a rectangular or hexagonal lattice for maximum density. Instead of using a corporate feed network to feed each element, the array can be fed from circumferencial points on the edge of the array farthest from the nose of the missile, with each element being electromagnetically coupled to each of its four or six adjacent elements by either dielectrically-loaded irises with concentric probes or simple irises. By differently tuning the individual cavities, the beam may be directed off-axis azimuthally in any forward direction.

6 Claims, 6 Drawing Sheets

FIG. 5
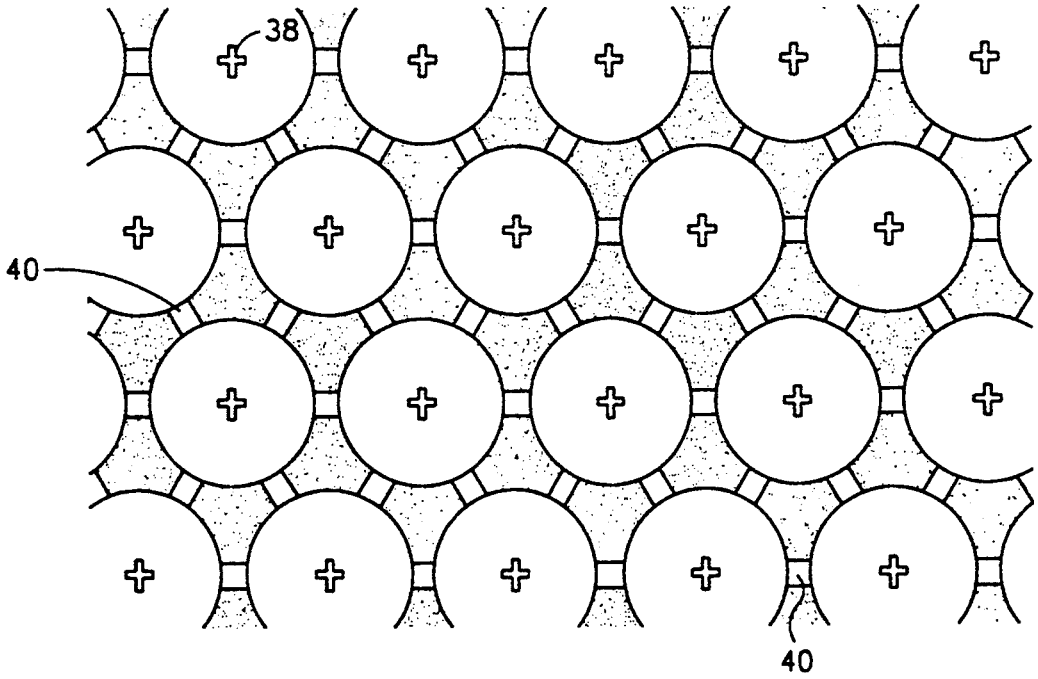
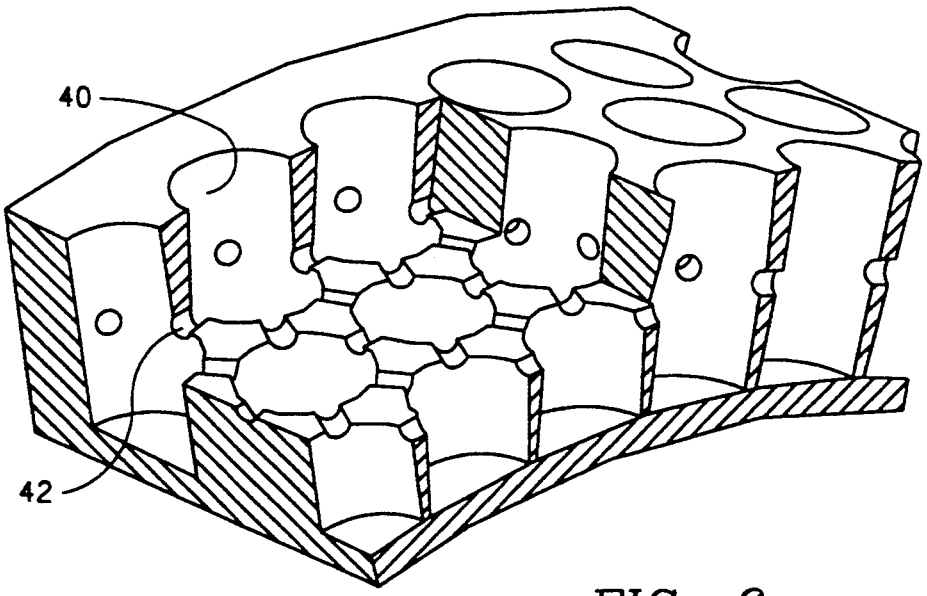
FIG. 6

CONFORMAL PHASED ARRAY ANTENNA

BACKGROUND OF THE INVENTION

1. Field of the Invention

This invention relates in general to electronically steered, two-dimensional, conformal, phased array antennae, and in particular to such antennae having two-dimensional, subsurface, traveling-wave excitation.

2. Description of Related Art

The related art in the field of electronically-large phased arrays has primarily involved electrically-large two-dimensional traveling wave arrays with electronic beam steering in two planes having endfire beams. Such arrays are necessarily very densely populated and include many hundreds, if not thousands, of elements, particularly at $K_u$ band. Further, wraparound conformal array configurations, physically extending 360° around the airframe axis become possible and desirable on cylindrical airframes, to achieve a full hemispherical beam steering coverage (forward hemisphere), or better yet, nearly full spherical coverage including all the forward and most of the backward hemisphere. Attaining such wide beam steering coverage makes many simultaneous operations possible, including wide-volume high-speed target search, multiple target tracking, proximity fuzing, terrain following, and ski skimming. Wide off-airframe-axis beam-steering close to the airframe roll plane is actually easier to obtain from cylindrical arrays than are endfire beams as it corresponds to broadside radiation for most of the array elements.

A two-dimensional traveling-wave array radiating an endfire beam, planar or conformal, is somewhat equivalent to an array of Yagi-Uda arrays. This analogy shows the relevance of some very recent work on the concept of supergain arrays. Indeed, supergain or quasi-supergain array designs are being considered as a viable and promising concept for seeker antenna applications. Investigators have shown that supergain performance is practical even in the case of cylindrical array radiating a broadside beam.

The innovative phased array teachings disclosed herein greatly reduce system complexity, volume and weight as well as development and production costs and make electronically-steered conformal phased arrays practical and affordable in smaller carrier airframes. These teachings also permit higher production yields, higher reliability and readiness in all applications, and greatly simplify logistical problems.

The inventive concepts include a new feed network configuration that can be designed to physically fit and perform a load bearing structural function within a very small internal depth below the external surface of a missile or other airframe. The new array-excitation method vastly reduces the requisite number of primary array feeding lines and control elements, particularly when frequency scanning can be used in one of the two beam-steering planes. The new pattern synthesis method provides the more rigorous and experimentally verifiable way of determining the required aperture distributions than is available in the prior art. The broadband capabilities of the tightly coupled delay structures serve to relax fabrication tolerance problems and make feasible many difficult broadband array applications. Finally, the new active array architecture eliminates the need for combining Transmit and Receive (T/R) functions into complex T/R modules and for using one such module to feed every array element.

The drastically reduced complexity of the new array configurations greatly increases the inner airframe space available for competing on-board payloads such as target identification processors, sophisticated guidance controls, proximity fuzes, auxiliary infrared seekers for dual-mode guidance, larger warheads, and more powerful and longer range propulsion systems.

These operational and technical benefits while eliminating all delicate moving parts and solving the conflicting technical problems typical of dual-mode Millimeter Wave/Infrared (MMW/IR) seeker systems.

Other advantages and attributes are readily discernible from this disclosure. The foregoing unresolved problems and deficiencies are clearly felt in the art and are solved by the invention in the manner described below.

SUMMARY OF THE INVENTION

All the radiating elements of an electrically large, planar or conformal antenna array are mutually interconnected through a single, matrix-like, isotropic delay structure. The delay structure extends behind the array aperture and propagates guided waves in any direction parallel to the array antenna aperture surface with the required linearly progressive phase for traveling wave array-excitation. The array antenna is excited by guided traveling waves through an underlying isotropic, matrix-like delay structure. The delay structure is fed around the entire perimeter of the array antenna aperture through a smaller number of continuous peripheral input ports. The selected input ports form an excitation-wave line source extending along a selected segment of the array antenna perimeter for each desired direction of the radiated beam. Electronic beam steering in a plane parallel to the array antenna aperture is accomplished by controlling a small number of microwave solid-state switches and phase shifters inserted along the array perimeter in external feeding lines. These switches select the set of active input ports on the array perimeter and the associated phase shifters control the linearly progressive phasing of the input signals.

Because of the isotropic wave propagation properties of the underlying matrix-like delay structure, guided array-excitation waves are then propagated in any desired direction parallel to the array aperture, depending on the switch and phase shifter settings. The radiated beam is then steered full circle in a continuous conical scan around a vector normal to the array aperture. Electronic beam-steering in a plane orthogonal to the array antenna aperture is accomplished with either frequency scanning or electronically controlling the guided array-excitation wave phase velocity through the underlying delay structure. Either of these methods is physically equivalent to electronically controlling the Brewster incidence angle between the radiated beam and the guided array-excitation waves.

Relatively broadband performance of electrically large planar or conformal arrays is obtained by designing the underlying matrix-like, isotropic delay structure as a tightly-coupled cluster of multiport microwave resonators. Multiband performance is obtained by distributing array elements of differing sizes across the aperture in a regular pattern derived from intermeshing at least two array lattices with different geometrical periodicity. Elements then are fed through mutually stacked independent delay structures.

Two mutually stacked, isotropic, matrix-like delay structures, both extending behind the antenna array aperture and having equal phase velocities, are interconnected at corresponding nodes by active, solid-state amplifiers, in a two dimensional, distributed amplifier configuration. The upper delay structure is directly connected to the array antenna elements. Both delay structures perform, in turn, the functions of input and output circuit, depending on whether the array is in transmit or receive mode. Power amplifiers used for transmission are connected with output ports toward the array elements. Low-noise amplifiers used for reception are connected with input ports toward the array elements. These two types of amplifiers are gated on and off in a mutually exclusive way.

BRIEF DESCRIPTION OF THE DRAWINGS

For a more complete understanding of the present invention, reference is now made to the following detailed description of the embodiments illustrated in the accompanying drawings, wherein:

FIG. 5 is a plan view of a fourth embodiment of the invention;

FIG. 6 is a cross-sectional view of a fourth embodiment of the invention;

DESCRIPTION OF THE PREFERRED EMBODIMENT

Figure 1:
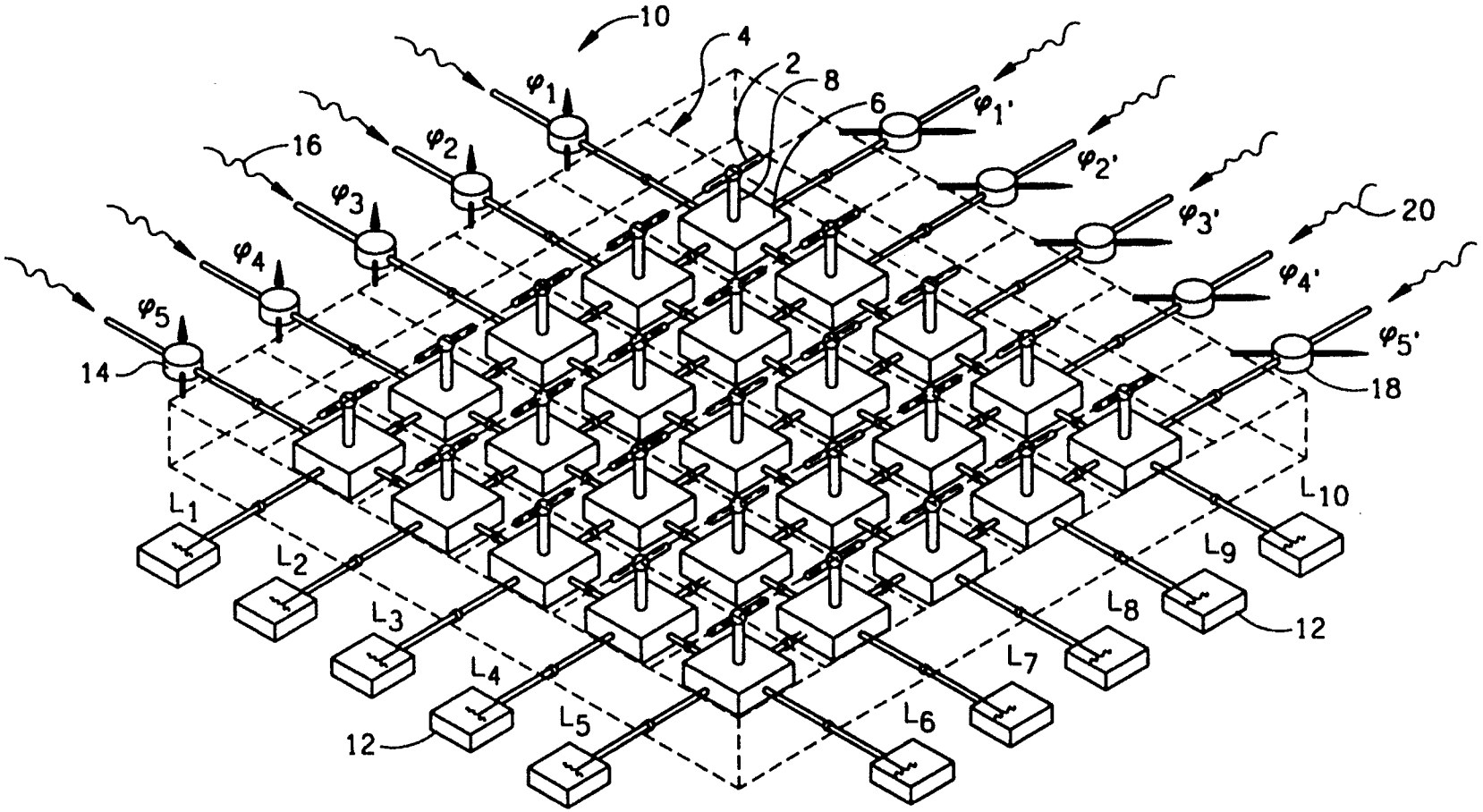
FIG. 1 is a schematic representation of the invention.

Referring to FIG. 1, a novel phased array antenna architecture is shown having a two-dimensional electrically large array of antenna elements, illustrated here as dipoles 2. Dipoles 2 are shown as being ordered in a single-layer square lattice, a five-by-five section being shown for example. The dipoles are all similarly oriented such that they together form a homogeneous two-dimensional antenna aperture surface 4 which can be planar or curved to conform to a desired shape. Each dipole is connected to a uniquely corresponding phase delay module 6 or "unit cell" by means of an electromagnetic wave coupler 8 communicating with a first wave port of the delay module. Preferably this and all couplers in this specification comprise guided wave couplers. The unit cells are configured in a square lattice, matching in form and number, and physically coextensive with the dipole array as a backplane of the dipole array. Except for the unit cells at the periphery of the lattice, each unit cell has four additional wave ports, each of which uniquely communicates with a neighboring unit cell. The unit cells at the periphery of the lattice each have three additional wave ports, each of which uniquely communicates with a neighboring unit cell, and a fifth wave port that communicates with either a source of excitation 10 or an impedance matching load 12. Configured and interconnected as such, the unit cells form a two-dimensional, isotropic wave coupling network performing at least two functions. Each unit cell couples signals to and/or from its corresponding dipole and the unit cells as a group function as phase delay modules in a two-dimensional signal distribution network.

Referring again to FIGS. 1–3, array excitation consisting of rim feeding is illustrated. Excitation signals 16 and 20 are applied, i.e., fed, to the unit cell array around its edges through a comparatively small number of peripheral input ports not exceeding the number of edge unit cells. The square lattice structure of the unit cells permits rows and columns to be arbitrarily assigned. For illustration purposes only, the lines of unit cells and their corresponding dipoles sloping downward from left to right are designated rows and the lines normal to them are designated columns. For each row a unit cell at one end uniquely communicates with a row phase shifter 14, which in turn selectively receives a row excitation signal 16, and the unit cell at the other end of the row communicates with a load 12 (L6–L10). For each column a unit cell at one end uniquely communicates with a column phase shifter 18, which in turn selectively receives a column excitation signal 20, and the unit cell at the other end of the column communicates with a load 12 (L1–L5). The unit cells at the ends of the rows and columns are referred to as peripheral units. Primary array feed lines will generally be connected to all peripheral ports lying on the perimeter of the array, but only a subset of contiguous peripheral ports need to be active at any particular time. The physical location of such subset depends on the desired direction of propagation of the excitation waves through the underlying two-dimensional delay structure, and on the corresponding beam steering direction in a plane parallel to the array aperture along the equatorial angles $\Phi$ in FIGS. 2 and 3. The excitation waves' propagation direction can also be controlled by linearly phasing the external feed signals along the selected set of active input ports, as will be explained further.

In operation, the backplane of unit cells propagates guided traveling array-excitation waves, with a linearly progressive phase from dipole element to dipole element, in any direction parallel to the antenna aperture. Under proper external excitation, the internal array excitation wavefront spans the total width of the array and propagates through the two-dimensional unit cell array in an arbitrary direction parallel to the aperture. Each unit cell linearly adds a delay to the wave propagation.

Figure 2:
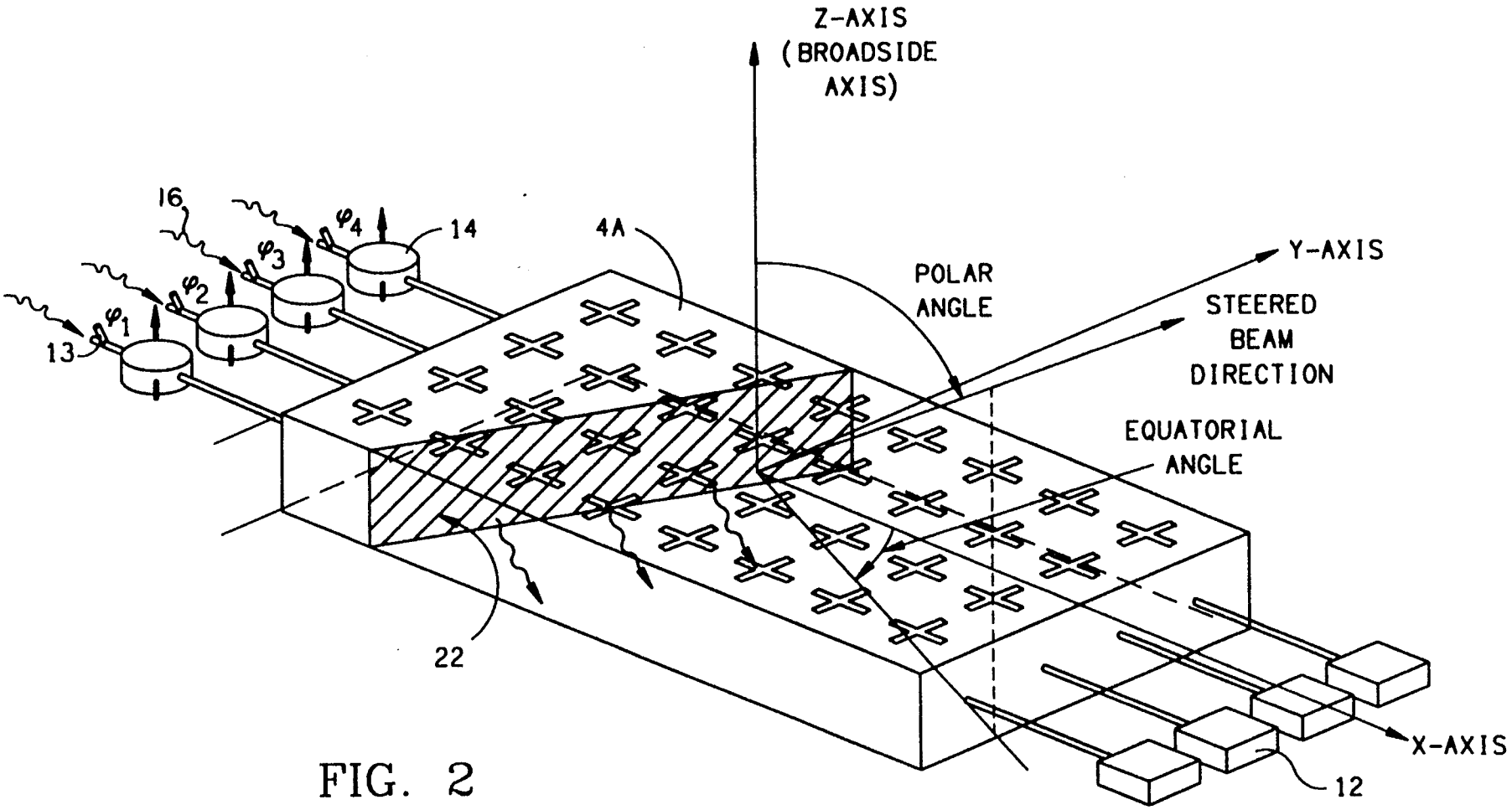
FIG. 2 is a schematic representation of row-wise excitation of the invention.

FIG. 2 shows a four-row by eight-column lattice of unit cells (not shown) with a steered-beam excitation wavefront 22 traversing the lattice at an equatorial angle determined by the selective excitation 16 of the four rows of unit cells. In this case the unit cells are coupling the excitation wave to crossed-slot antenna elements. This illustrates row-wise array excitation with linear excitation phase progression where the top row leads and the bottom row lags. In the case of row-wise array excitation with equal phase excitation signals, the equatorial angle would be 0 degrees (along the X-axis).

Figure 3:
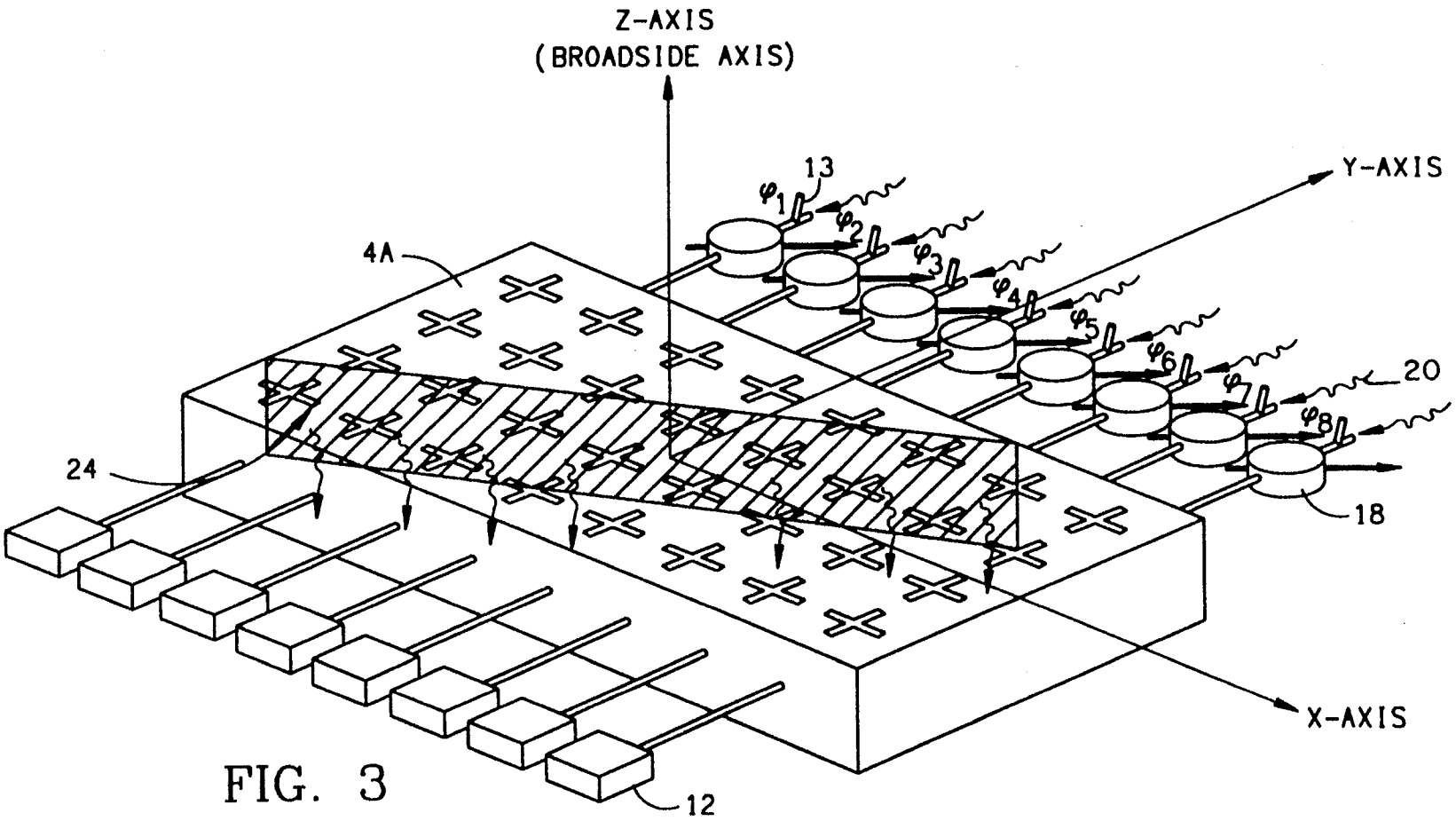
FIG. 3 is a schematic representation of column-wise excitation of the invention.

FIG. 3 shows a four-row by eight-column lattice of unit cells (not shown) with a steered-beam excitation wavefront 24 traversing the lattice at an equatorial angle determined by the selective excitation 20 of the eight columns of unit cells. Again, the unit cells are coupling the excitation wave to crossed-slot antenna elements. This illustrates column-wise array excitation with linear excitation phase progression where the leftmost column leads and the rightmost column lags. In the case of columnwise array excitation with equal phase excitation signals, the equatorial angle would be −90 degrees (along the Y-axis).

The beam steering directions as shown in FIGS. 2 and 3 can be reversed by injecting equal-phase feed signals along the rightmost array column ($\Phi=180°$) or along the bottom row ($\Phi=90°$), respectively.

In the limit of an electrically large array, such as a microwave conformal array on a missile airframe, the delay structure resembles a single molecular layer sliced from a crystal. This phased array configuration is particularly advantageous for electrically-large, high-gain, two-dimensional, traveling-wave, conformal arrays with electronic beam steering in two planes and endfire capabilities; the type most suited for seeker applications in missiles and RPVS.

The new array design drastically reduces the well-known complexity of phased arrays by replacing the conventional intricate, voluminous, heavy and costly array feed network, such as conventional corporate feed networks, with a system of short electromagnetic interconnections spanning the very small interelement spacings of the array.

The innovative concept of two-dimensional subsurface traveling-wave array-excitation illustrated in FIG. 1 is a conceptual extension of the well-known series-fed linear array concept to a two-dimensional traveling-wave phased array. The one-dimensional delay line that usually connects adjacent linear array elements is replaced with an isotropic, matrix-like electromagnetic delay structure or "artificial delay surface" that is intrinsically image-matched to its external boundaries. This new method of array-excitation actually amounts to series-feeding in two-dimensions.

Figure 4:
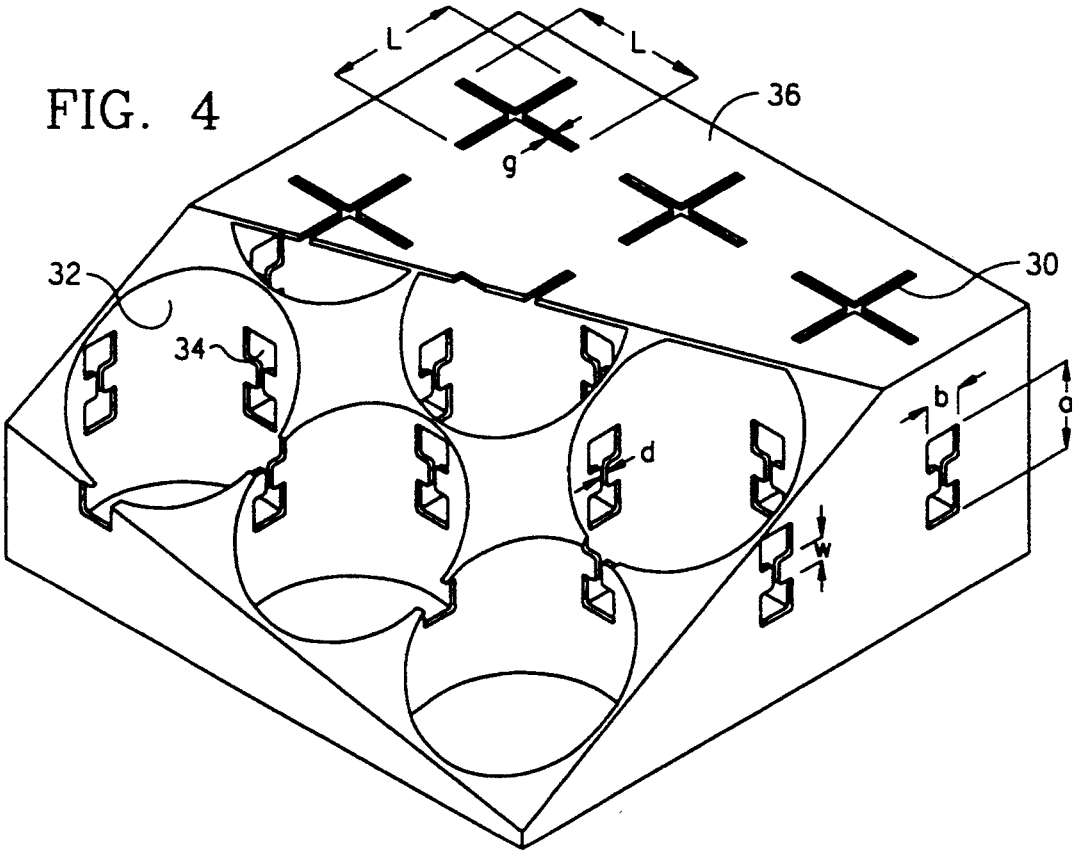
FIG. 4 is a cross-sectional view of a cross-slot, cavity-backed embodiment of the invention.

The invention as illustrated in FIG. 1 can be realized in many different embodiments, depending on the type of array element and unit cell network selected. The embodiment illustrated in FIG. 4 is particularly well-suited for use as a conformal array for missiles and RPV seekers. The individual antenna array elements are dual-polarization, crossed-slots 30 and the individual unit cells are resonant, multiport, cylindrical $TE_{111}$ cavities 32 backing the crossed-slots. The $TE_{111}$ cylindrical cavities each have six microwave ports 42, four cylindrical wall coupling irises 34 and two radiating crossed-slots in the top shorting plane 36. Such cavities behave as orthomode microwave hybrids with little or no coupling between the two sets of diametrically opposed irises. Multiport backing cavities are particularly well-suited because:

(a) the internal resonant field polarizations are easily matched to the orientation of the corresponding slot elements;

(b) having transverse dimensions slightly smaller than the inter-element spacings;

(c) having a small internal depth, on the order of a free space wavelength;

(d) being easily coupled through multiple irises;

(e) naturally leading to a rigid "engine-block" load-bearing electromechanical structure; and (f) being intrinsically high Q, low-loss devices.

This last characteristic is essential to achieving a low-loss, high-efficiency traveling-wave feed network.

Referring to FIGS. 5 and 6, a more densely packed array is illustrated. As in FIG. 4, the antenna array comprises crossed-slots 38, which are backed with a resonant cavity, but in this case the cavities 40 each have at least eight ports 42; two for the crossed-slots, six for communicating with the neighboring cavities, and, in the case of peripheral cavities, one or two for communicating either with a matching load or an excitation source.

Figure 7:
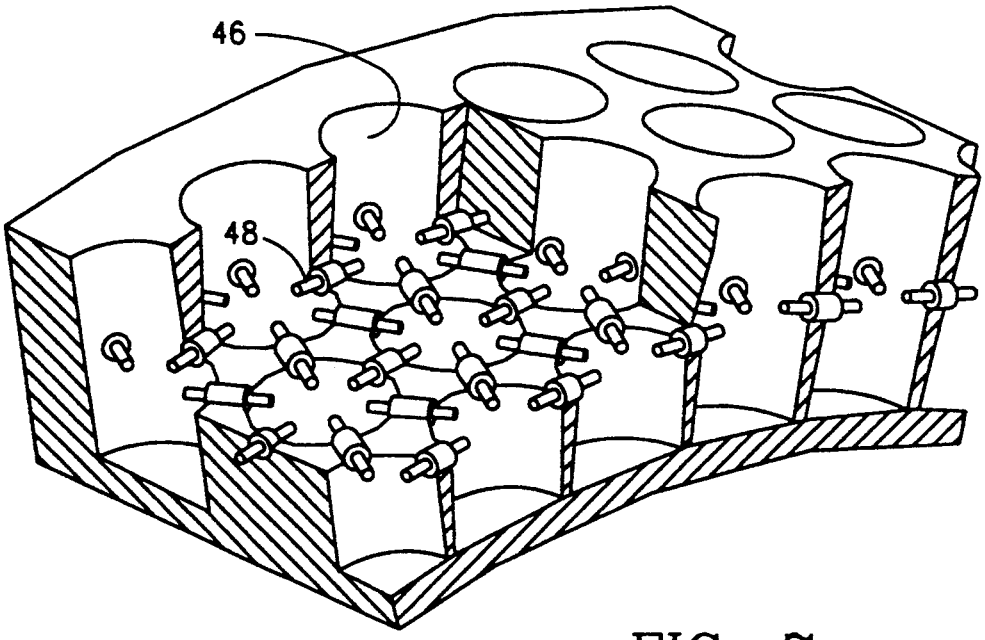
FIG. 7 is a cross-sectional view of a fifth embodiment of the invention.

Referring to FIG. 7, a further embodiment of this invention is shown. Cylindrical resonant cavities 46 in a conformal structure are shown to be side-coupled to the neighbors by means of probes 48, such as coaxial probes.

The invention is completely general and equally applicable to arrays with different types of elements. Indeed, printed circuit array elements such as dipoles or patches may be clustered with a two-dimensional network of strip-line interconnections. The resulting system would, however, surely be electrically more lossy and mechanically less rigid.

A first method of electronic beam steering is proposed to steer the radiated beam full circle around a normal to the array aperture, in a plane orthogonal to the aperture, as shown in FIGS. 2 and 3. The most appropriate set of active perimetral input ports would be selected by means of electronically-controlled microwave switches 13. An appropriate linear phasing would be introduced along such a selected set of active input ports by the electronically-controlled phase shifters 14. These controls can generate a continuous conical scan around a normal to the aperture in the direction of the equatorial angle. FIGS. 2 and 3 show how the direction of the array-excitation waves propagating through the underlying two-dimensional delay structure can be continuously rotated in any direction parallel to the array aperture by introducing a linearly progressive phasing of the feed signals injected along the selected set of active input ports.

The combined action of input port switching and feed signal phasing would continuously rotate the steering direction of the radiated beam in a conical scan around the normal to the array aperture (the Z-axis in FIGS. 2 and 3). The radiated beam can be steered a full 360° in a continuous conical scan around the broadside axis ($\Phi$-scanning or equatorial scanning), by a combination of (a) input port switching or "directional excitation" and (b) linear progressive phasing of the selected active ports or "perimetral phasing."

A second beam steering method is proposed for steering the beam in a plane orthogonal to the array aperture surface ($\Theta$-scanning or polar scanning). Beam steering in such a plane would be obtained by electronically controlling the incremental phase shift of the array-excitation waves through the unit cells of the delay structure or, more directly, by controlling the "image phase rotation" of the delay structure. This is equivalent to controlling the phase velocity of the guided array-excitation waves or, in the limit of an electrically large array and using an optical analogy, to controlling the "effective index of refraction" of the delay structure. This control would be easily obtained in a delay structure configured as a large-scale two-dimensional cluster of mutually-coupled multiport microwave resonators, such as the multiport cavities 32 in FIG. 4, because such structures behave electrically like bandpass dispersive artificial delay lines, with at least one passband centered around the nominal array center frequency. They have a sharply frequency dependant image phase rotation. Electronic beam steering in any polar plane orthogonal to the array aperture and containing the broadside axis may then be attained by either tuning the array operating frequency of the unit-cells or by tuning the resonant unit-cells relative to the array operating frequency.

The first method amounts to frequency scanning in the polar Θ plane while the second requires the use of electronic tuning elements such as varactors or garnet spheres in some or all of the unit cell networks. The choice between these two alternatives depend on whether frequency scanning is usable, as in active missile seekers, or not usable, such as in broadband passive antiradiation seekers. The physical mechanism used in polar scanning is, in the limit of electrically large arrays, electronic control of the Brewster angle between the direction of the array excitation waves propagating underneath the aperture, and the direction of the radiated beam. These two directions are both in a plane normal to the array aperture as in optical refraction and at a mutual angle corresponding to the Brewster incidence. The equivalent wavelength of the excitation waves, appears larger than the free-space wavelength because of the wave sampling action of the discrete array elements. This sampling action introduces a form of spatial aliasing that creates a false spatial periodicity. The delay structure thus appears to have a phase velocity higher than the speed of light and an effective index of refraction less than unity, as required for Brewster incidence refraction from the structure towards free space. This physical interpretation is quantitatively accurate for the stated assumptions.

Note that, if electronic tuning elements are distributed across the unit cell structure and used to selectively control the local value of the phase velocity, the unit cell structure will behave as an electronically-controlled, two-dimensional Luneberg lens with adaptive wave focusing and imaging capabilities that may be used to reconfigure the array aperture distribution.

A new pattern synthesis method has been developed that first requires the very close correlation between a desired array far-field pattern, the corresponding near-field pattern, the corresponding planar wave or cylindrical wave modal expansions, and the corresponding aperture surface amplitude and phase distributions.

This close correlation is established by using an equivalent aperture known to generate the desired far-field pattern. The near-field pattern of the equivalent aperture is then computed as an intermediate means for computing the modal expansion coefficients for the characteristic modal spectra of the antenna. The near-field pattern may also be experimentally accessible by planar or cylindrical near-field scanning and can provide a comprehensive, detailed characterization of the fields radiated by both the equivalent aperture and the phased array being designed. The new synthesis method for creating conformal array far-field patterns is properly described as "pattern synthesis in the spectral domain" and is based on a least-squares approximation of the desired planar or cylindrical spectra with linear vectorial combinations of the partial spectra of single array elements and of increasingly larger sub-arrays.

For conformal phased arrays on the substantially cylindrical airframe surfaces of missiles and RPVs, both planar and cylindrical modal spectra are relevant and essential to the new pattern synthesis method. The cylindrical spectra can be expanded from cylindrical near-field patterns coaxial to the airframe, while the planar spectra can be expanded from near-field patterns on a plane orthogonal to the air-frame axis just ahead of the nose cone. Mutual correlations and re-expansions of planar and cylindrical modal spectra can be obtained by approximation-free pseudoanalytic continuation operations. Such operations provide a way of circumventing the validity domain limitations of both types of modal expansions, and of computing, for example, the far-field of an end-fire beam steered along the airframe axis in the forward direction, from an experimentally accessible cylindrical near-field pattern coaxial to the airframe. This is useful because planar and cylindrical wave modal expansions are only valid in domains free of singularities, such as sources, sinks or scatters.

The new design concepts for broadband and multifrequency arrays are based on a new equivalent circuit treatment of wave propagation on infinite, two-dimensional delay structures such as shown in FIGS. 1–3. This new theory proves the possibility of broadband transmission through tightly coupled clusters of multiport microwave and millimeter wave resonators. The attainable bandwidths increase rapidly with increasing mutual unit cell coupling, greatly exceeding the isolated array element bandwidth.

Figure 8:
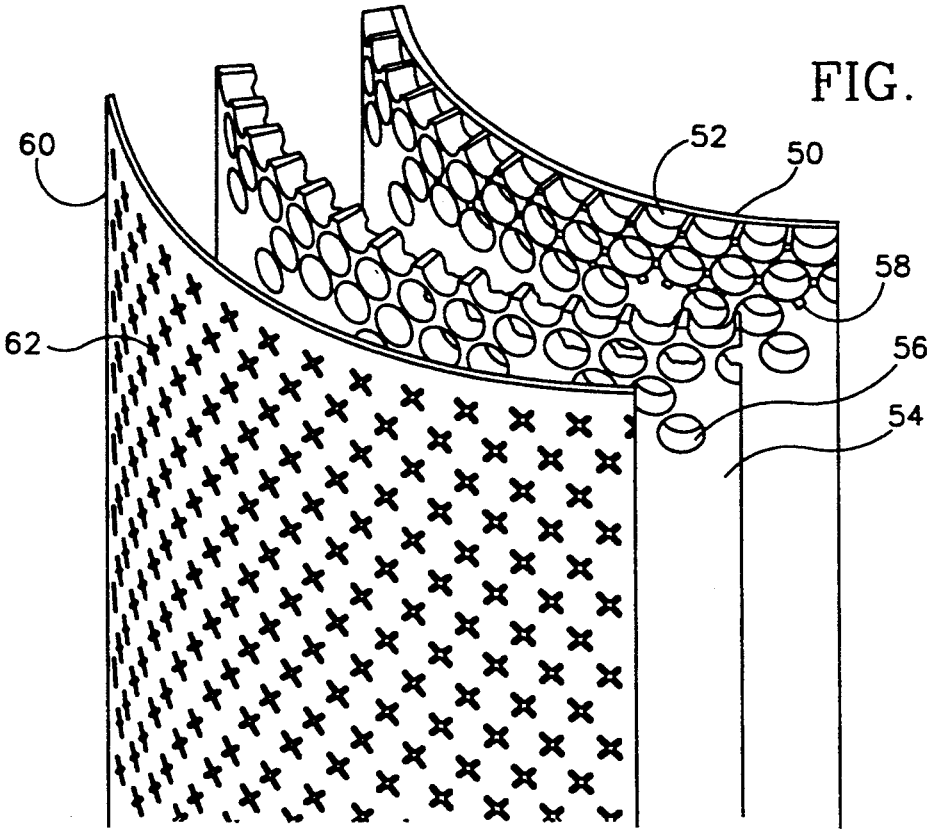
FIG. 8 is an exploded view of a conformal, cavity-backed, cross-slot array embodiment of the invention.

In FIG. 8, a construction technique for assembling a conformal, crossed-slot, cavity-backed antenna array architecture is shown. A first layer 50 comprising depressions 52 that form the base portion of a set of cavities is shown to be a base structure. Applied to the base is a second layer 54 of cylindrical through holes 56 which form the upper portion of the cavities. The cavities are formed in this manner to facilitate the construction of the side coupling irises 58. The last layer to be applied is a sheet 60 defining the antenna elements comprising crossed-slots 62.

The foregoing description and drawings are provided for illustrative purposes only. The invention is not limited to the embodiments disclosed, but is intended to embrace any and all alternatives, equivalents, modifications and rearrangements of elements falling within the scope of the invention as defined by the following claims.

I claim:

1. A phased array antenna comprising:

a two-dimensional array of antenna elements configured in a lattice all antenna elements being similarly oriented to form a two-dimensional antenna aperture surface;

an array of units cells configured in a lattice structure that matches, at least in number and form, the layer of the antenna elements and which is physically coextensive therewith as a back plane, each unit cell comprising:

at least one means for delaying the phase of an electromagnetic wave passing therethrough, and means for electromagnetically coupling each unit cell to a uniquely corresponding antenna element;

means for electromagnetically coupling each unit cell to each of the adjacent unit cells;

means external to the back plane for providing electromagnetic excitation, the phase of which has been selectively delayed, at input ports defined by a set of backplane peripheral unit cells of said array of unit cells; and means for terminating in a matching impedance the backplane peripheral unit cells which are not being excited.

2. A phased array antenna for transmitting/receiving an electromagnetic beam in which said electromagnetic beam is steerable in any direction orthogonal to an aperture of said antenna, said antenna comprising:

an array of antenna elements configured in a two-dimensional lattice;

an array of unit cells configured in a two-dimensional lattice comprising rows and columns and having a periphery, one unit cell corresponding to each antenna element, each unit cell inducing a phase delay in an excitation wave traveling through said array of unit cells;

a first plurality of couplers for coupling each unit cell to its corresponding antenna element;

a second plurality of couplers for coupling said each unit cell to all adjacent cells;

a plurality of phase shifters disposed at a first peripheral row and a first peripheral column; and a plurality of terminating loads disposed at a second peripheral row and a second peripheral column;

wherein said excitation wave introduced into said first peripheral row or said first peripheral column travels through said array of unit cells towards said second peripheral row or said second peripheral column.

3. A phased array antenna as in claim 2 further comprising a plurality of microwave switches for at least partially controlling steering of said excitation wave.

4. A phased array antenna as in claim 2 wherein said each unit cell comprises a multi-port backing cavity.

5. A phased array antenna as in claim 2 wherein said each unit cell comprises a cylindrical resonant cavity, and said second plurality of couplers are probes.

6. A phased array antenna as in claim 2 wherein all antenna elements of said array of antenna elements are similarly oriented.

* * * * *